United States Patent [19]

Miller et al.

[11] 3,978,997

[45] Sept. 7, 1976

[54] DOOR TRIPPING DEVICE FOR RAILWAY HOPPER CAR

[75] Inventors: Roy W. Miller, Highland; Eugene I. Varda, St. John, both of Ind.

[73] Assignee: Pullman Incorporated, Chicago, Ill.

[22] Filed: Apr. 28, 1975

[21] Appl. No.: 572,684

[52] U.S. Cl. ..... 214/63; 105/241 C

[51] Int. Cl.[2] ..... B65G 67/24

[58] Field of Search ..... 214/58, 63; 105/241 C, 105/308 R, 308 P, 308 E; 74/567, 568 R, 568 FS, 568 M

[56] References Cited

UNITED STATES PATENTS

| | | | |
|---|---|---|---|
| 2,430,517 | 11/1947 | Lunde | 105/308 E |
| 2,815,721 | 12/1957 | Shields | 214/58 X |
| 3,266,679 | 8/1966 | Arbel | 105/241 C X |
| 3,765,341 | 10/1973 | Ried | 105/241 C |
| 3,872,796 | 3/1975 | Adler et al. | 105/241 C |

*Primary Examiner*—L. J. Paperner
*Assistant Examiner*—Randolph A. Reese
*Attorney, Agent, or Firm*—Richard J. Myers

[57] ABSTRACT

A railway hopper car is provided with bottom discharge doors which include an opening and closing mechanism for each of the doors. The mechanism comprises a bell crank lever and linkage arrangement which in the closed position assumes an over-center lock position. The doors are initially actuated to an open position for affecting gravity discharge by means of a track side cam. A second closing cam structure is provided, which, as the car passes therethrough on opposite sides of the track, the bell crank lever and linkage mechanism is again moved to its closed over-center position locking the doors. The closing cam includes a spring actuated portion built into the cam face which is adapted to assist in the operation of the bell crank lever again moving to its over-center position.

10 Claims, 4 Drawing Figures

43
52
53
54
57
61
56
59
48
60
74
79
65
64
62
78
67
66
73
75
69
68
72
58
63
71
33
29
34
72'
76
70
77
44
51

43
47
46
61
59
57
56
60
50
63
62
66
67
69
75
48
58
44
55

DOOR TRIPPING DEVICE FOR RAILWAY HOPPER CAR

A related patent application is Ser. No. 415,098 filed Nov. 12, 1973 now U.S. Pat. No. 3,872,796.

BACKGROUND OF THE INVENTION

1. Field of the Invention.

The invention relates to railway hopper cars and particularly those which include bottom gravity discharge openings actuated by means of track side cam arrangements. The present invention relates particularly to an improved cam arrangement for effectively closing the doors through an improved cam actuating mechanism.

2. Description of the prior art.

The prior art is exemplified in U.S. Pat. Nos. 1,266,630 May 21, 1918; 3,314,558 Apr. 18, 1967; 3,459,317 Aug. 5, 1969 and 1,803,384 May 5, 1931.

SUMMARY OF THE INVENTION

A hopper car actuating mechanism for opening and closing the bottom discharge doors of a hopper includes a pivoted bell crank arm or lever which includes a linkage attached to the door, the said bell crank being pivoted into an over-center position during the closed position of the doors. Opening cams are provided along the track side which engage a follower on the bell crank lever to pivot the same from the over-center position to a position wherein the door is partially opened and the load is discharged by gravity, the door arrangement then assuming a completely opened position.

An improved closing cam arrangement is provided on the opposite sides of the track and is engaged by a second follower on the bell crank lever which engages an inclined cam swinging the bell crank lever and linkage arrangement to return to its over-center position. The track side closing cam arrangement includes sloping cam surfaces which function to close the doors when the car is moving in either direction. Centrally positioned between the cam surfaces is a pocket within which a U-shaped cam is resiliently positioned and includes a cam surface follower projecting outwardly from the inclined cams. The bell crank lever engages the resilient cam which is guided within the pocket for limited movement laterally outwardly and inwardly as the said follower engages the outer cam surface. Suitable guide means are provided on the U-shaped cam and compression springs bias the U-shaped cam to its outer most projecting position. The cam arrangement is pivotally mounted on a base so that the entire unit can be hingedly moved to a non-use position when desired.

DESCRIPTION OF THE PREFERRED EMBODIMENT

Figure 1:
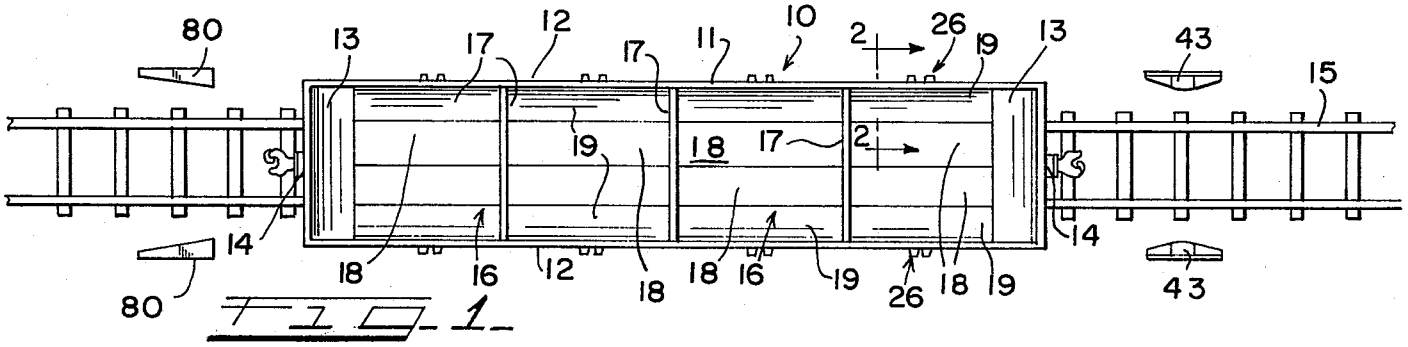
FIG. 1 is a plan view of a railway hopper car positioned on a track with suitable cam arrangements provided adjacent thereto.
Figure 2:
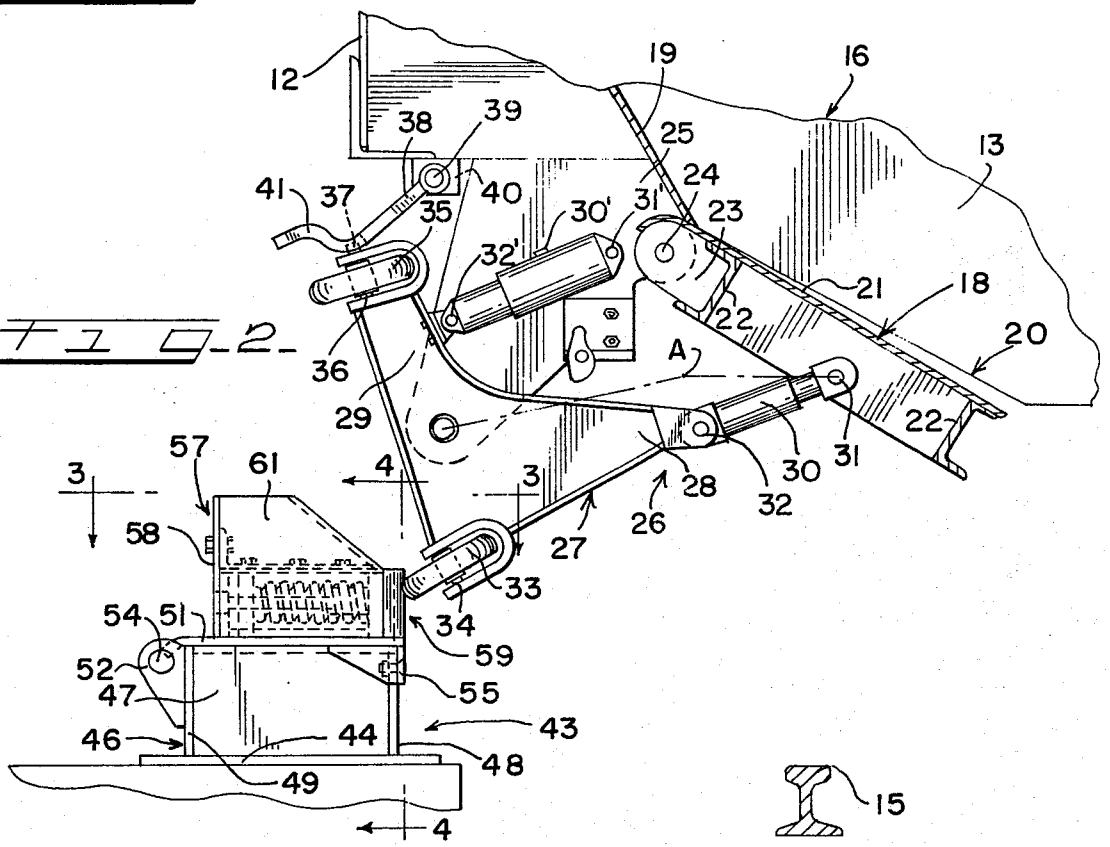
FIG. 2 is a cross-sectional view taken substantially along the line 2—2 of FIG. 1.

The railway hopper car 10 includes a body 11 provided with sidewalls 12 and endwalls 13. The body is supported on a sill and underframe structure 14 projecting outwardly from opposite ends of the car the same including conventional couplers and wheel trucks for support the same on a railway track 15. The hopper car 10 includes a plurality of hoppers 16 divided by vertical divider walls 17. As best shown in FIGS. 1 and 2, the hoppers are provided at their lower ends with pairs of bottom dump doors 18 for discharging materials from the hopper. The body also includes slope sheets 19 which direct the material downwardly through a discharge opening 20 provided for each of the hoppers. As best shown, each of the doors 18 includes a bottom door plate 21 suitably supported on a structure comprising longitudinal beams 22. Each of the doors 18 is provided with a suitable pivot bracket 23 which is connected by means of a longitudinal pivot shaft 24 to a suitable bracket structure 25 supported on the lower portion of the body 11.

A door actuating mechanism generally designated at 26 is provided for actuating each of the doors 18 to open and closed positions. The door actuating mechanism 26 includes a bell shaped crank lever 27 provided with an arm or lateral extension 28 and a substantially upright or vertical arm 29. This type of actuating mechanism 26 is well disclosed in aforementioned patent application Ser. No. 415,098 filed Nov. 12, 1973. The arm or lateral extension 28 is connected by means of a link 30 and a pivot connection 31 to the door 18 and is pivotally connected to the arm 28 by a pivot connection 32. The upright arm 29 is suitably connected by a spring link arrangement 30' and a pivot connection 31' to the bracket 25. The spring link 30' is also connected pivotally by pivot means 32' to the upper portion of the upright arm 29. The detail of the spring link construction 30' is disclosed in detail in the aforementioned application. The bell crank lever arm 27 is pivotally connected to the bracket 25 by means of a pivot connection 42. Positioned at the juncture of the lower portion of the arm 29 and the arm 28 is a lower cam follower or roller assembly 33 journaled on a pivot shaft 34. Similarly the upper end of the arm has an upper roller or follower assembly 35 journaled on a shaft 36. The shaft 36 includes an outwardly extending shaft or stud portion 37 which is engaged by a notch (not shown) on an auxiliary latch 38 pivoted at 39 on a bracket 40 connected to the lower portion of the body 11. The function of the auxiliary latch 38 is also disclosed in the aforementioned patent application. The latch 38 is also provided with a curved end 41 which is adapted to be actuated by means provided on an opening cam (not shown) to disengage the latch from a locking position prior to opening, the same also being disclosed in the aforementioned application.

Figure 3:
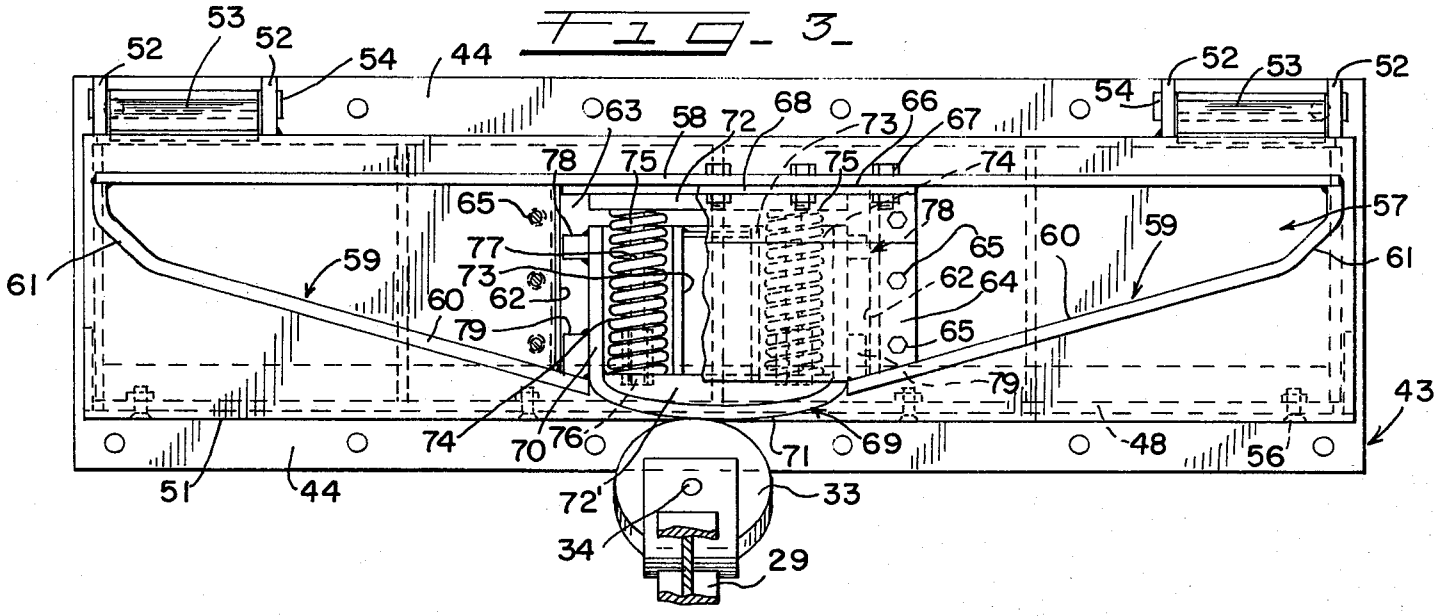
FIG. 3 is an enlarged plan view partially cross section along the line 3—3 of FIG. 2 of an improved closing cam.
Figure 4:
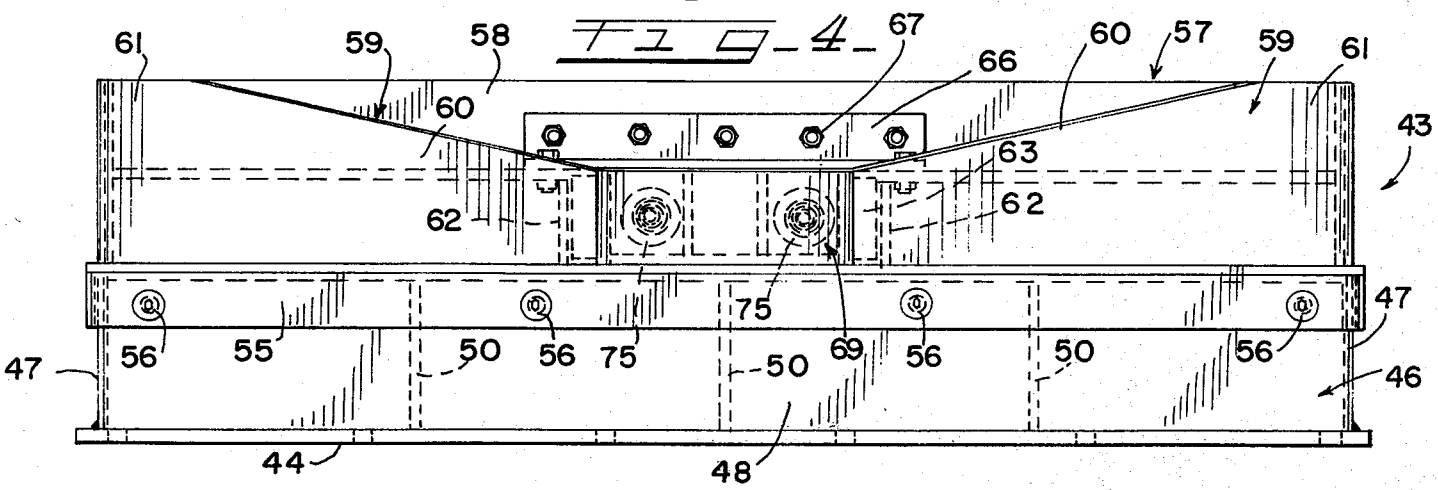
FIG. 4 is a front elevational view of the cam shown in FIG. 3 along the line 4—4 of FIG. 2.

A closing cam arrangement 43 as shown in FIG. 1 is positioned on opposite sides of the track and is adapted to engage the actuating mechanisms 26 for each of the doors 18 of each hopper. The closing cam arrangement 43 comprises a base 44 positioned alongside the track on the ground. A pedestal box structure 46 is supported on the base 44 and includes endwalls 47, front walls 48 and a rear wall 49. As best shown in FIGS. 3 and 4, the walls are suitably reinforced by vertical spaced reinforcing plates 50. As best shown in FIG. 2, a cam plate base portion 51 is supported on the pedestal structure 46. The cam plate base 51 is hinged on pivot brackets 52 supported on the rear wall 49 by means of hinge flaps 53 extending from the plate 51 and suitably connected in hinging relation to hinge pins 54. The plate 51 is provided at its forward end with a downwardly extending skirt portion 55 which overlaps the front wall 48 and is removably connected thereto by means of a plurality of removable fasteners 56. A cam assembly is generally designated at 57 and includes a vertical backing plate 58 extending substantially the length of the cam plate base 51. A pair of cam members 59 are connected to the backing plate 58, the said cam members 59 being vertically disposed and including sloping sections 60 which in the plan view shown in FIG. 3 extend diagonally outwardly from the ends of the backing plate 58 or inwardly relative to the track 15. Sections 61 connected to Section 60 also extend sharply diagonally inwardly and then laterally for attachment of the cam members 59 to the backing plate 58. The end sections 61 as best shown in FIG. 4 are high at their ends connecting the sections 59 to the backing plate 58 and the upper edges of the sections 60 extend diagonally downwardly toward their outermost terminal end. Adjacent their terminal ends of the sections 59 are horizontally spaced vertical plates 62 which provide an enlarged space or pocket 63 communicating with an enlarged space provided by the terminal ends of the sections 60. The space or pocket 63 is closed by means of a top plate 64 and is connected thereto by suitable removable fasteners 65. An angle shaped reinforcing member 66 is positioned on top of the plate 64 and is connected to the backing plate 58 by means of removable fasteners 67. An additional backing plate 68 is rigidly connected to the rear end of the pocket 63. A laterally movable cam generally designated at 69 is positioned within the pocket 63 and includes an inverted U-shaped housing 70 provided at its outer end with a curved cam surface 71 projecting outwardly from the terminal ends of the diagonal cam sections 61. A spring backing plate 72 is secured to the backing plate 68 within the pocket 63. The U-shaped housing 70 further comprises a pair of vertically spaced plates 73 forming with the walls of the U-shaped housing spring pockets designated at 74. Coil compression springs 75 are seated at the rearward ends against the backing plate 72 and are anchored at their forward ends on a front backing plate 72' which is curved to complement the inner surface of the outer cam surface 71. The front backing plate 72' supports a pair of sleeves 76. Guide rods 77 are supported on the rear backing plates 72 within the springs 75 and have their ends slidingly positioned relative to the sleeves 76 so that the springs remain properly centered within the spring pockets 74. As best shown in FIG. 3, the sidewalls of the bell shaped housing 70 have connected thereto spaced guide block 78 and stop blocks 79, which are suitably guided by the walls 62.

OPERATION

The operation of the door actuating mechanism 26 is described in detail in the aforementioned patent application. Briefly, as the car moves along the track to a dump pit extending underneath the track 15, it passes through opening can arrangements 80 which initially function to disengage the latch 41 from lock relation relative to the stud 37 and the upper follower wheel or roller 35 engages the cam, thereby moving the bell-crank lever 29 from the over-center position designated by the broken line A, in FIG. 2, to a partial open position. The weight of the material within the hopper forces the doors completely open and the load is discharged. The discharge of the materials may be through the track into an open dump pit and as the empty car moves along the track it passes through the closing cam arrangements 43. The doors are ready to be closed and the lower followers or wheels 33 first engage one of the end sections 61 and then ride upon one of the inwardly inclined cam sections 60 which pivots the bell-shaped crank arm 27 in a counter-clockwise direction shown in FIG. 2 toward the over-center position designated by the broken line A. Thus the cam sections 60 force the lower end of the arm inwardly actuating the doors toward their closed position. As the follower wheels 33 travel into the area of the spring loaded laterally movable cam assembly 69 the door is almost in a closed position. The lower follower 33 now bears against the cam surface 71 of the spring loaded locking cam which in turn forces the doors closed and locked into the over-center position. Thus each of the doors on opposite sides of the car are firmly and positively locked in the over-center position designated by the line and reference A.

When the closing cam arrangement is desired to be moved out of the way, the removable fasteners 56 are removed from the skirt 55 and the entire assembly consisting of the plate 51 and the closing cam can now be pivoted about the hinge pins 54 to an out-of-the-way position in back of the pedestal structure 46.

What is claimed is:

1. In a railway hopper car having a body structure and a hopper, bottom dump door means hingedly connected to said body for hinging movement downwardly about a longitudinal axis from a closed to a discharge position;

a bell crank shaped lever having a substantially upright arm and a laterally extending arm, first pivot means connecting said lever to said body for pivotal movement about a longitudinal axis, a strut including second pivotal means connected to said laterally extending arm and third pivotal means connecting said strut to said door means, said second pivotal means in a closed position of said door being disposed in an over-center position relative to said first pivotal means and said third pivotal means, a stop carried on said body limiting the movement of said door means to said over-center position, cam engageable means on said upright arm, the improvement comprising, a closing cam mechanism including a base supported adjacent track means on which said railway car is traveling, a vertical pedestal member supported on said base, camming means on said pedestal including a vertical cam having vertical cam sections each extending from an opposite longitudinal end of said pedestal diagonally inwardly relative to said track means, said cam sections terminating in laterally spaced ends to provide a space there-between, said pedestal including a laterally extending pocket communicating with the space provided by said lateral ends, a laterally movable cam disposed in said pocket, said cam including an outer cam surface extending from said pocket to provide a continuous camming surface with said cam sections, and biasing means within said pocket for biasing said outer cam surface in a lateral direction toward said track means, whereby said cam engageable means initially engages and travels along one of said cam sections during movement of said car and thereupon engages said biased laterally movable cam which exerts an inwardly directed force for moving said lever to its over-center position.

2. The invention in accordance with claim 1, said laterally movable cam having an arcuate vertical cam surface projecting outwardly from said space.

3. The invention in accordance with claim 2, said biasing means including compression springs confined within said pocket.

4. The invention in accordance with claim 1, said pocket including a vertical backing plate and vertical side plates connected to inner surfaces of said cam sections, said laterally movable cam having a U-shaped configuration provided by vertical side walls, an arcurate vertical cam surface connected to said vertical side walls and normally projecting outwardly through said space, and said biasing means including springs held captive between said vertical side walls, said cam surface and said backing plate.

5. The invention in accordance with claim 4, including stop means on said vertical side walls for limiting outward lateral movement of said laterally movable cam.

6. The invention in accordance with claim 5, said stop means being in relative sliding engagement with said vertical side plates of said pocket to guide said cam during lateral movement.

7. The invention in accordance with claim 6, said pedestal being hingedly connected to said base whereby said pedestal may be moved to an out-of-the-way position.

8. The invention in accordance with claim 1, said cam engageable means including a roller adapted to roll along said cam sections and engage said lateral cam for closing and locking said door means in said over-center position.

9. The invention in accordance with claim 1, said roller being journalled on said laterally extending arm of said lever.

10. In a railway hopper car having a body structure and a hopper, bottom dump door means hingedly connected to said body for hinging movement downwardly about a longitudinal axis from a closed to a discharge position;

a bell crank shaped lever having a substantially upright arm and a laterally extending arm, first pivot means connecting said lever to said body for pivotal movement about a longitudinal axis, a strut including second pivotal means connected to said laterally extending arm and third pivotal means connecting said strut to said door means, said second pivotal means in the closed position of said door being disposed in an over-center position relative to said first pivot means and said third pivotal means, a stop carried on said body limiting the movement of said door means to said over-center position, cam engageable means on said upright arm, the improvement comprising, a closing cam mechanism including a base supported adjacent track means on which said railway car is traveling, a vertical pedestal member supported on said base, camming means on said pedestal including a vertical cam having a vertical cam section extending from a longitudinal end of said pedestal diagonally inwardly relative to said track means, said pedestal including a laterally extending pocket adjacent an inner end of said cam section, a laterally movable cam disposed in said pocket, said cam including an outer cam surface extending from said pocket to provide a continuous camming surface with said cam section, and biasing means within said pocket for biasing said outer cam surface in a lateral direction toward said track means whereby said cam engageable means initially engages and travels along said cam section during movement of said car and thereupon engages said biased laterally movable cam which exerts an inwardly directed force for moving said lever to its over-center position.

* * * * *